United States Patent [19]

Kinnan

[11] Patent Number: 4,957,173

[45] Date of Patent: Sep. 18, 1990

[54] METHOD AND APPARATUS FOR SUBSOIL DRILLING

[75] Inventor: Frank R. Kinnan, Camas Valley, Oreg.

[73] Assignee: Underground Technologies, Inc., Byron, Calif.

[21] Appl. No.: 366,661

[22] Filed: Jun. 14, 1989

[51] Int. Cl.[5] ..... E21B 7/06; E21B 7/18

[52] U.S. Cl. ..... 175/61; 175/67; 175/73; 175/320; 175/324; 175/424

[58] Field of Search ..... 175/74, 75, 73, 61, 175/67, 231, 256, 424, 267, 324, 320

[56] References Cited

U.S. PATENT DOCUMENTS

| | | | |
|---|---|---|---|
| 2,345,766 | 4/1944 | Miller | 175/256 |
| 2,643,859 | 6/1953 | Brown | 175/73 |
| 3,199,615 | 8/1965 | Storm | 175/73 |
| 3,457,999 | 7/1969 | Massey | 175/256 X |
| 4,286,676 | 9/1981 | Nguyen et al. | 175/320 X |
| 4,597,454 | 7/1986 | Schoeffler | 175/61 |
| 4,790,394 | 12/1988 | Dickinson, III et al. | 175/67 X |
| 4,899,835 | 2/1990 | Cherrington | 175/74 |

*Primary Examiner*—Hoang C. Dang

*Attorney, Agent, or Firm*—David Teschner

[57] ABSTRACT

A method and apparatus for creating an underground bore hole using high pressure fluid within a drill string to disturb and displace the subsoil. The drill string is steerable by increasing the pressure of the fluid above a predetermined range to a second range and apparatus is responsive thereto to effect a bending movement and change in the direction of the drill string.

12 Claims, 2 Drawing Sheets

METHOD AND APPARATUS FOR SUBSOIL DRILLING

BACKGROUND OF THE INVENTION

1. Field of the Invention

The invention is directed to the field of subsurface drilling with the use of high pressure fluid for the installation below ground of various utility items such as electrical cable, conduit, water pipes, sewer pipes and the like.

2. Description of the Prior Art

When the land has no structures, plantings, parking lots, etc., upon it, the usual quickest and least expensive method for underground installation of utility items such as electrical cables, conduit, water pipes, sewer pipes and the like is to cut or dig a straight sidewall trench of the appropriate depth, lay the object at the trench bottom and cover it with the soil removed during the trench formation. The trench is quickly dug using mechanized equipment such as trenchers, front loaders, bulldozers or the like, or dug manually.

However, when the land has been improved, installation, removal and/or replacement of below-ground utility items to avoid damage or destruction to any such improvements is both slow and expensive. Often, space and access limitations prevent any methods other than manual trenching from being used. In addition to the work itself, there is the disruption of land use and the expense of restoring the trenched area to its former appearance.

In an effort to minimize surface disruption and minimize the costs of surface reconstruction, devices have been developed to bore beneath the surface of land and create a bore hole into which cable, conduit, pipe or the like could be inserted without disturbing the surface of the land or those structures thereon. A first type of device was created to permit the replacement of electrical cables and used those cables to guide their movement through the soil which was removed by means of one or more fluid jets. The old cable was pulled from the bore and a new one inserted. A tool of this type is shown in U.S. Pat. No. 4,385,667 issued May 31, 1983 and in U.S. Pat. No. 4,403,667 issued Sept. 13, 1983.

Although this type of device works well for previously installed electrical cable replacement, it is not suitable for new cable installations because there is no cable to follow and thus no means to independently guide the tool.

U.S. Pat. No. 4,306,627 issued Dec. 22, 1981, shows and describes a tool which can be used for a new installation. A rotating fluid jet drilling nozzle is advanced by a pipe string in much the same manner as a rock drill is employed to dig oil or gas wells. Despite mechanisms to control the position of the nozzle, as is shown in U.S. Pat. No. 4,674,579, issued June 23, 1987, it is still difficult to steer the boring head mounted at the end of a pipe string required to push and advance the boring head. Specifically, the angle that the nozzle and head is placed in, in relation to the longitudinal axis of the pipe string, is fixed. Such a fixed angle adds difficulty in varying the radius of the turn.

A particular disadvantage of the system described in the '579 patent is that if too sharp a radius is attempted to be made, the next successive section of pipe may bind as it advances to the area where the head formed the tightest radius. This then requires additional more complicated cutting steps in order to navigate turns in such areas.

The present invention, rather than being dependent solely upon fluid cutting for steering, as provided in the '579 patent, instead utilizes fluid pressure to effect a positive action on the drill head to thereby direct the drilling head in the desired direction. By causing the drill string pipe itself to effect this movement over a longer radius, it lessens the likelihood of subsequent pipe strings binding at the turning point.

In applicant's copending application Ser. No. 07/115,987, filed Nov. 2, 1987, now U.S. Pat No. 4,905,773, there is disclosed both method and apparatus of controlling the direction of a subsoil boring tool. In such application, a series of four circumferentially arranged hydraulic pistons are used to both cooperatively push and pull and thereby turn the boring head in the desired direction. Though this device works well, it requires separate hydraulic and electric lines along with solenoid valves to provide adequate control. Such a boring tool, having numerous hydraulic and electric devices and lines, are expensive to manufacture and complicated to operate, and may not conveniently be used with the "pipe string" type drilling where new sections, without attendant control lines, are constantly added as the boring head advances.

SUMMARY OF THE INVENTION

The present invention overcomes the difficulties noted above with respect to prior art devices for installing, removing and/or replacing existing utility items.

The present invention utilizes high pressure fluid to facilitate a more direct and positive steering action with greater variability to create a longer (or more shallow) curve for the drill pipe to follow. This is accomplished by applying different fluid pressures inside the drill string so that the direction of the drill nose assembly can be changed.

It is a principal object of the invention to provide an improved steering mechanism which employs a fluid jet to create a bore and a rotating, forward-driven length of drill pipe to propel the nose assembly containing the jet along such bore, while utilizing the fluid flow also to effect a positive steering effect on the boring head, as opposed to a reactive type of steering, as in the prior art.

It is still another object of the invention to provide a remotely-operated steering mechanism for a fluid operated subsoil penetration tool having few moving parts and providing positive steering in response to the variance of pressure of the high pressure fluid flowing through the pipe string.

Other objects and features of the invention will be pointed out in the followng description and claims and illustrated in the accompanying drawings, which disclose, by way of example, the principles of the invention and the best mode which has been presently contemplated for carrying them out.

BRIEF DESCRIPTION OF THE DRAWINGS

In the drawings, in which similar elements are given similar reference characters.

DESCRIPTION OF THE PREFERRED EMBODIMENT

Figure 1:
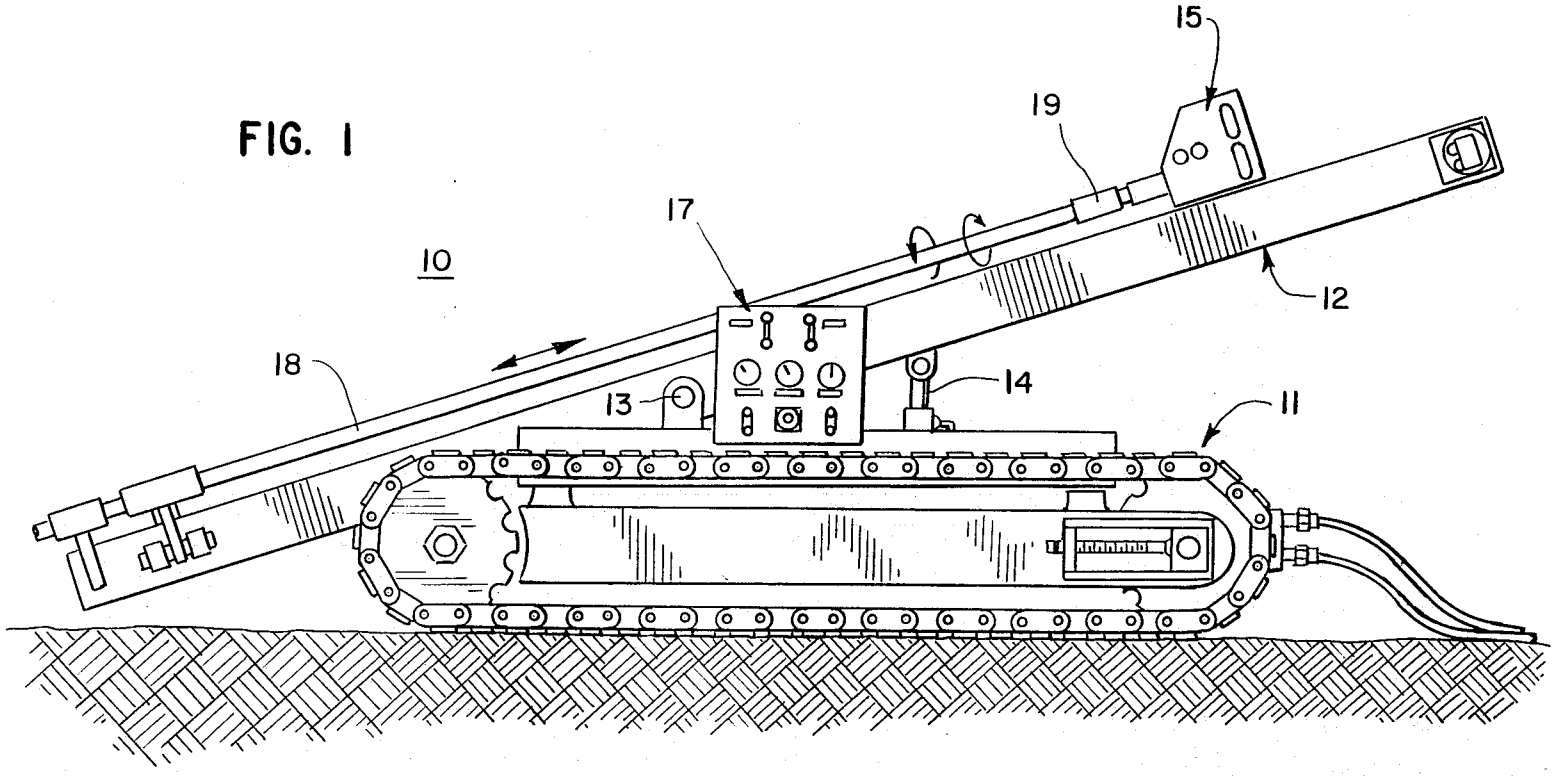
FIG. 1 is a side view of a drill pipe rotating and advancing apparatus.

FIG. 1 is a generally schematic view of one form of equipment useful for the present invention. It depicts a device for positioning the pipe strings prior to insertion into the soil and includes a main drilling frame 10 on which are mounted various elements of the system. The frame 10 includes a tractor and base arrangement 11 to position the frame relative to the appropriate opening and which would be connected by suitable electronic and hydraulic facilities to a mixing tank, an appropriate source of diesel power and high pressure pump lines (none of which are illustrated but all of which are well known to those skilled in this art).

The drilling frame includes a boom 12 which is inclinable to any convenient angle for insertion of the nose assembly and subsequent pipe strings in the soil to be drilled. The boom 12 is connected at pivot 13 to base 11 and by boom cylinder 14 whereby the boom inclination angle may be changed. A hydraulic motor 15 is mounted to boom 12, and includes provision for the lateral movement of the motor 15 along the boom. The motor 15 may be advanceable by well known means such as a chain or hydraulic motor (not shown). A high pressure swivel 19 is connected to the shaft of the motor 15. A section or string of pipe 18 also is connected to swivel 19 by means of appropriate and well known couplings. The swivel 19 allows the supply of high pressure fluid to the pipe 18 and the motor 15 rotates the pipe. Advancement of the motor 15 along the boom 12 also causes the nose assembly and subsequent lines of pipe string 18 to be advanced axially. A control panel 17 is provided for effecting the various movements of the boom, motor, pipe direction and rotation and fluid pressure.

The swivel normally is supplied with fluid at a pressure of about 1500 to 2000 pounds per square inch. The fluid may be water or a water/Betonite slurry or other suitable cutting fluid. The supply may be from a conventional high pressure pump, as previously noted.

In normal drilling operation, a series of pipe strings would be connected to one another in well known fashion as drilling progresses through the subsoil. The pipe strings are pushed forward simultaneously by rotational movement of the pipe caused by motor 15 and by movement of the motor 15 along the boom 12.

The apparatus described in FIG. 1 is generally well known in the art and specifically forms no part of the present invention. The drill pipe 18 for example may be the normal steel pipe having a male member provided at one end and complementary female member opening at the other end whereby strings of pipe 18 may be assembled as the pipe is advanced in the underground bore.

Figure 6:
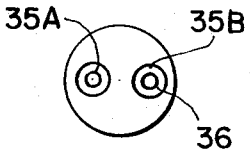
FIG. 6 is an end view showing the location of the fluid nozzles.
Figure 7:
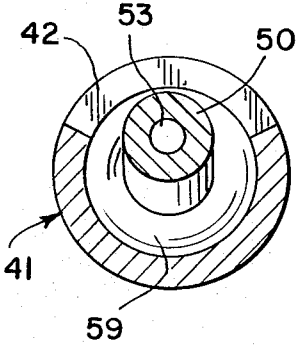
FIG. 7 is a sectional view of the steering mechanism, taken in the direction of the arrows 7—7 in FIG. 2.

The present invention incorporating the novel steering mechanism is now best illustrated in FIGS. 2 and 3 and is described in greater detail hereinafter. There is shown generally a drilling and steering assembly 20 which consists of a nose member 30 and a steering mechanism or section 40. The nose member 30 generally consists of a solid stainless steel member in which a continuous fluid passage 33 is provided from one end to the other. The passage 33 within nose member 30 terminates at a chamber 34 within which are disposed a pair of nozzles 35(*a*) and 35(*b*) (FIG. 6). They are provided at the terminal end of the nose member and are both fed by fluid flowing through passage 33, chamber 34 and then out through the nozzles.

As is understood in high pressure drilling, the viscous fluid generally is provided at a relatively high pressure (1500–2000 PSI) for the purpose of cutting and loosening the subsoil ahead of the rotating pipe thereby facilitating the forward movement of the pipe through the bore. For purposes of the present invention, and for the illustrated embodiment, each of the nozzles 35(*a*) and 35(*b*) is provided with a sequential pair of carbide inserts, designated generally as 36 and 37 (FIG. 2). A pair of inserts is used to minimize wear and to further control the fluid flow. Each insert has an internal orifice there through which, for examplar purposes, may be 0.015 inch.

Figure 2:
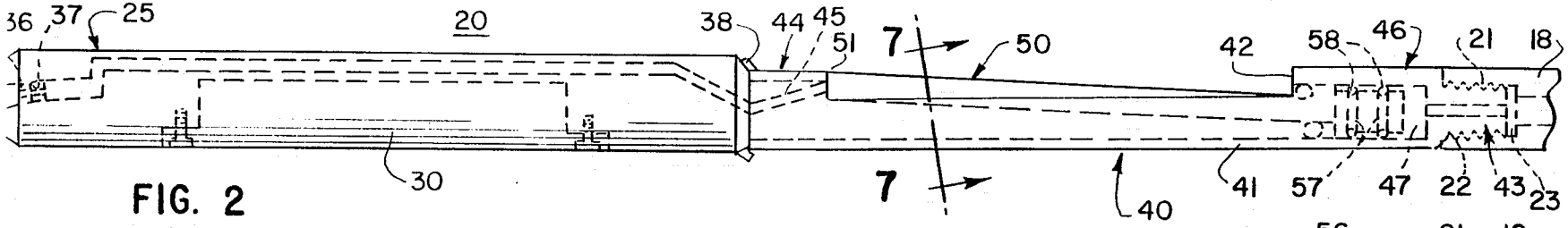
FIG. 2 is a side view of the nose assembly and the steering section of the present invention, in the normal drilling position.
Figure 3:
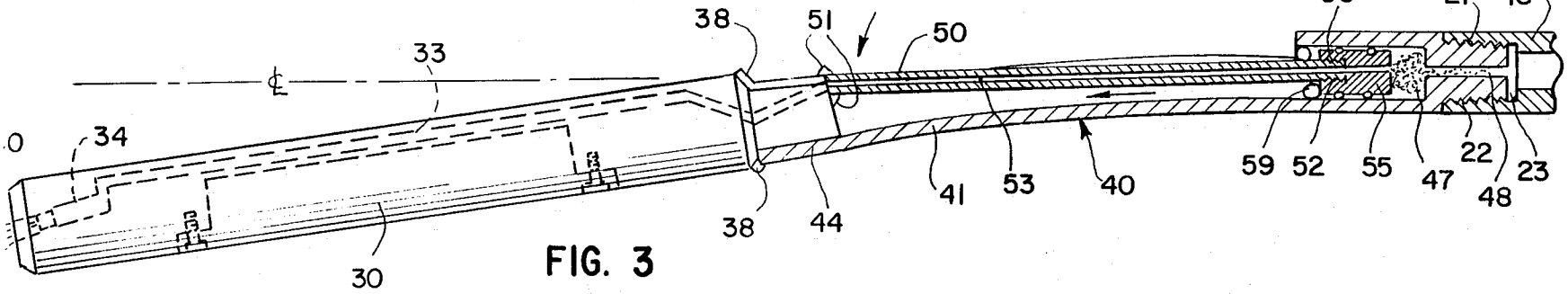
FIG. 3 is similar to FIG. 2, but with portions of the steering mechanism cut away, and illustrating the parts in position for turning or changing direction.
Figure 4:
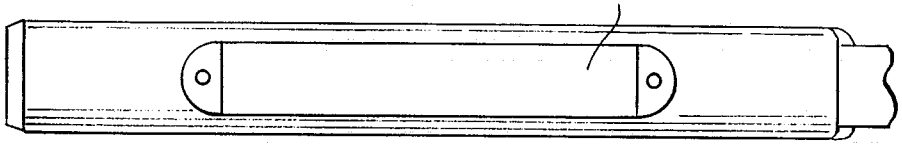
FIG. 4 is a bottom view of the nose assembly, showing the compartment within which is placed a locating transmitter.
Figure 5:
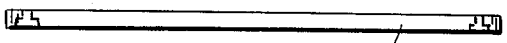
FIG. 5 is an end view of the plastic lid which encloses the transmitter compartment.

Also as illustrated in FIGS. 2 and 3, the axes of nozzles 35(*a*) and 35(*b*) (and inserts 36, 37) may be inclined at a predetermined angle relative to the longitudinal axis of the nose member 30 in order to facilitate the cutting and loosening of soil. Unlike the prior art, this inclination of the nozzle axes is to control the size of the cut rather than for steering. For purposes herein, the nose member may consist of stainless steel having an outer diameter of 1½ inches and the fluid passageway 33 may be 3/16th inch in diameter.

The inserts 36, 37 will be able to accomodate fluid flowing through the passageway 33 at a predetermined pressure in the range of 1500–2000 PSI. If that pressure is exceeded, then the orifices in the inserts 36–37 will not be able to accomodate any additional flow and the viscous fluid will back up within the passageway 33. It is this back up in pressure, in combination with the steering assembly of the present invention, which allows the positive force of that fluid to effect direct movement of the nose member in a predetermined direction.

To accomplish this movement, the steering section 40 is provided.

The steering section 40 consists of a stainless steel tube 41 which matches the male end of the nose member and is welded thereto as at 38 in order to assure that the two members (25, 41) are firmly connected to one another. In the illustrated embodiment, the tube 41 has a section removed therefrom from a first or forward end 44 toward the second end at 46 (FIG. 2). The tube 41 further is provided with a passage 45 therethrough which is in direct communication with the passage 33 which flows through nose member 30. The second end (46) of the tube 41 is provided with an internal chamber 47. Chamber 47 is in communication with fluid from the pipe 18 via passageway 48.

The female end of pipe 18 is shown threaded at 21 in a tapered pipe fit to a male threaded end 22 of tube 41. To assure that the high pressure fluid does not escape and that the joint transmits rotational motion in either direction, a brass washer 23 is inserted between the complementary male and female members.

Fitted to tube 41 is a hollow push rod 50. One end of the rod 50 firmly affixed to the tube 41 at the first end 44 thereof, as by welding 51, in a fashion such that the passage 53 formed within rod 50 will be in direct communication with the passage 45 which leads to passage 33 in nose member 30. The opposite end of the rod 50 is provided with a male threaded end 52 (FIG. 3). A piston 55 is disposed within chamber 47 at the second end 46 of tube 41. The piston 55 may be internally threaded as at 56 in order to fixedly receive there the male end of rod 50.

A pair of grooves 57 may be provided on the piston 55 for the purpose of receiving o-rings 58 therein. A substantially larger sealing ring 59 also may be provided around rod 50 at the terminal end of chamber 47.

In normal operation, high pressure fluid will flow through the passageway in the pipe string 18, through washer 23, passage 48 and the fluid will enter piston chamber 47 which then flows through a bore within the piston and thence through passageway 53 in hollow rod 50. Fluid continues to flow through push rod 50 into and through passageways 45 and 33, chamber 34, and thence through the carbide inserts 36 and 37 from where it will be ejected from nose assembly from nozzles 35(*a*) and 35(*b*). During drilling, the rods and steering mechanism will be rotated clockwise or counterclockwise depending at the direction of the operator.

Depending upon the diameters of the orifices provided in the carbide inserts 36 and 37 and of the accompanying chambers and rods, only a certain rate of flow of the viscous fluid corresponding to a predetermined pressure will be allowed to flow through the passageways and ultimately exit through nozzles 35(*a*) and 35(*b*). Once this predetermined pressure is exceeded, an increasing back pressure is created in chamber 47. This differential in back pressure will cause piston 55 to move a limited distance in the direction of the fluid flow. A greater liquid pressure will create a greater back pressure in chamber 47 and will result in a greater movement of the piston 50 within chamber 47. Movement of the piston will correspondingly move push rod 50 which, as noted, is fixedly connected to nose member 30. Because tube 40 has a portion thereof which has been removed, the tube is somewhat flexible and thus the forward movement of cylindrical push rod 50 will cause the tube 41 to bend, thereby causing the nose assembly and steering mechanism to arc away from the longitudinal axis or the center line in the direction of arrow 60 (FIG. 3).

The degree of movement of the nose assembly of the steering mechanism from the longitudinal axis is directly proportional to the back pressure of the liquid in piston cavity 47. If a tighter arc is needed for a smaller turning radius, additional pressure may be placed upon the fluid flowing into chamber 47. If less arc is needed, less pressure is used. If no steering is necessary, the pressure is reduced in an amount which is less than the predetermined pressure for that purpose which still is adequate to permit the cutting fluid nozzles to properly function. As the pressure drops to the first predetermined level, the tube 41 will act like a spring and will cause the push rod 50 to exert force on piston 55 so that the piston will move rearwardly within the chamber 47 until the tube 41 is generally longitudinally parallel to its axis as illustrated in FIG. 2.

While a large "cut out" portion is provided in tube 41, other configurations may be used to render the tube flexible, such as a series of notches or small cut sections.

For straight boring, a fluid pressure at a first predetermined range is used. The pipe 18 rotates about its longitudinal axis and moves along that axis in the direction of the boring operation. This, of course, will carry with it the drilling and steering assembly 20. The nose assembly 30 will move forward and rotate in accordance with the movement and rotation of the drill pipe string 18. Such movement and rotation of the nose assembly 25, while fluid is being ejected from nozzles 35(*a*) and 35(*b*), will cause the jet from those nozzles to break up and disrupt the subsoil in front of the nozzles in a circle concentric with the longitudinal axis of the pipe 18. The drill pipe normally is 1½ inches in diameter and since the nose assembly is generally the same diameter, there will be an adequately sized subterranean tunnel formed as the nose assembly moves forward.

When a change in direction is desired, because of an obstruction or a necessary change in course, all action is stopped and the then rotational orientation of the nose member 30 is determined. To make this determination, a transmitter of the style manufactured by the Radiodetection Corporation of Ridgewood, N.J. may be placed within compartment 31 in nose member 30 and it will be activated. A receiver above the surface is monitored while slowly rotating the drill string 18 and thus nose member 30. When the received signal is strongest, the orientation of the nose member 30 is such that the plastic lid 32 covering compartment 31 will be facing the surface. Then if a turn to the right is desired, the drill pipe 18 will be rotated 90° degrees to the right of that beginning orientation; likewise for a left turn it will be rotated 90° degrees to the left. For an upward curve, the pipe will not be rotated and for a downward curve the pipe 18 will be rotated 180° degrees.

Once the nose member 30 is oriented for creating the curve in the desired direction and thus steering the pipe properly, the fluid pressure through the passageways is increased in pressure to greater than the initial predetermined pressure range used for cutting and straightforward motion. This causes not only the nozzles 35(*a*) and 35(*b*) to continue to eject fluid but also causes the piston 55 to move forward in the chamber 47, the amount of movement being dependent upon the orifice diameters of the inserts 36 and 37, the diameter of the piston chamber and the predetermined degree of flexture of the tube. Normally, for the items that are provided herein where the push rod 50 is steel having a ½ inch outer diameter and a 3/16ths inner diameter and where the carbide nozzle inserts 36, 37 each have an orifice of 0.015 inches, a pressure increase to 3000 PSI will affect about a three-quarter inch deflection of the nozzle end of the nose member, while a pressure increase to about 4000 PSI will effect a deflection of about 1½" of the nose member. This is accomplished by having a stainless steel tube which is about 4 feet long having a 1¼ inch outer diameter and a generally ¾ inch inner diameter with approximately a ½ inch circumferential section 24 inches long being removed from the tube 41.

Once the direction is determined and the pressure is increased to the second predetermined range level, the fluid jets will continue to emanate from the nozzle but will of course be slightly off center. These will also cut an off center bore but the off center bore is not determined because the nozzles are disposed at an angle (but that may facilitate such cutting) as desired. Once the change in direction is accomplished forward motion (without rotation) in conjunction with the high pressure fluid will enlarge the "nonaxial" bore in the general direction of the longitudinal axis of the drill pipe but in the new direction as determined by the degree of deflection of the nose member caused by the curve effected within the tube. Once this off center bore is long enough to hold the entire nose assembly in its new off center position, straight drilling can resume. Because this turn is accomplished by a fairly small deflection in the member and a fairly large radius, the following sections of drill pipe which are somewhat flexible will not bind up within the curve.

While the restricted orifice of the nozzle inserts 36, 37 is disposed at the terminal end of nose member 30, such control for effecting movement of the piston 55 can in fact be accomplished by providing similar inserts at the terminal end of the push rod 50 whereupon perhaps a tighter degree of control will be provided. If desired the nozzles 35(*a*) and 35(*b*) also may be fitted within such that the nozzles themselves containing the inserts can be removed so that different diameter inserts can be inserted or a segment of the nose member itself carrying inserts of different diameters may be threaded into the terminal end of nose member 30.

While there has been shown, described and pointed out the fundamental novel features of the present invention as applied to the preferred embodiments, it will be understood that various changes in the form and details of the devices illustrated in their operation may be made without departing from the spirit and scope of the invention.

What is claimed is:

1. A steering mechanism for a subsoil drilling tool comprising:

a nose member having a passageway therethrough and nozzle means to eject viscous fluid therefrom;

steering means comprising a bendable member for supporting the nose member and having a longitudinal axis and having first and second ends, said first end being operatively connected to said nose member, and said second end being configured for operative connection to a string of trailing, hollow drill members;

a rod coupled between the first and second ends of the bendable member, said rod including a passage therethrough in communication with both said drill string and said nose member such that viscous fluid under a given pressure may flow therethrough;

said steering means including means responsive solely to an increase in the given pressure of the viscous fluid flowing into said steering means from said drill string to force said bendable member to bend out of its longitudinal axis and thereby effect a change in direction of said nose assembly and thereby the following drill string.

2. The mechanism of claim 1 wherein said means responsive to said increased pressure change for causing said steering means to bend comprises:

said rod extending substantially between said first end and said second end of said steering means;

means fixedly attaching one end of said rod to one end of said steering means; and means for moveably attaching said rod at the other end to the other end of said steering means such that said change in the given fluid pressure effects a bending moment of said bendable member by longitudinally moving said rod.

3. The mechanism of claim 2, wherein said rod is fixed near said first end of said bending member and is movable longitudinally relative to said second end of said bending member.

4. The mechanism set forth in claim 3, wherein said bendable member includes a tube like member which is configured and arranged to permit flexure.

5. The mechanism of claim 4 wherein said second end of said tube like member is formed to provide a chamber therein for receiving the fluid under pressure and one end of said rod is configured as a piston disposed within said chamber, whereby when said increase in pressure is received within said chamber, said piston is moved towards said first end of said tube like member thereby causing said rod to apply a bending movement to said tube like member.

6. The mechanism of claim 1 further including:

an orifice of predetermined diameter in said nose member to permit only limited fluid flow therethrough for the given fluid pressure such that an increase in the given fluid pressure causes an increase in the fluid pressure upstream of said orifice; and piston means in said steering means upstream of said orifice and responsive solely to said increase in the given fluid pressure to effect longitudinal movement of said rod to cause the bending movement of said steering mechanism.

7. The mechanism of claim 6, wherein said orifice of predetermined diameter causing the back pressure is disposed within said nozzle means at the terminal end of said nose member.

8. The mechanism set forth in claim 6, wherein said orifice is disposed at the first end of said steering means.

9. The mechanism of claim 4, wherein said tube like member is configured and arranged to provide flexure by having portions thereof removed between said first and second ends thereof.

10. A steering mechanism for a subsoil drilling tool comprising:

(a) a nose member having a passageway therethrough and nozzle means to eject the viscous fluid therefrom; said nozzle means being provided at its distal end with an orifice of predetermined diameter permitting only limited fluid flow therethrough corresponding to a predetermined pressure such that an increase in the pressure of fluid arriving thereat would cause an increase in fluid pressure upstream of said orifice;

(b) steering means comprising a bendable member having a longitudinal axis and having first and second ends, said first end being operably connected to said nose member and said second end being adapted for operative connection to a string of trailing hollow drill members;

(c) said steering means including a fluid passage therethrough in communication both with said drill string and said nose member whereby viscous fluid may flow through said nozzle means orifice;

(d) said bendable member including a tubular member having portions thereof removed between said first and second ends whereby such tubular member is bendable;

(e) said steering means further including a hollow rob extending between said first end of said tubular member and a chamber disposed within said tubular member near said second end thereof;

(f) said rod being provided with a piston adjacent to one end thereof for slideable movement in said chamber and being fixed at the other end thereof to the first end of said tubular member; and (g) said chamber being in communication with said passageway through said rod and through said second end of said tubular member whereby an increase of fluid pressure at said chamber will cause said piston to move within said chamber and thereby cause said rod to bend said tubular member and effect a steering action on said mechanism.

11. A method of drilling an underground bore hole comprising the steps of:

(a) providing a nose assembly having a nozzle means to eject a pattern of viscous fluid to disturb and displace subsoil thereby cutting a bore in a first direction;

(b) connecting said nose assembly through a bendable mechanism having a longitudinal axis to a length of trailing drill pipe, said bendable mechanism including a bendable member and a rod having a passage extending therethrough in fluid communication with the drill pipe and the nose assembly, said rod having one end fixedly connected to one end of the bendable member and the other end slidably connected to the other end of the bendable member;

(d) providing said predetermined pressure of said viscous fluid while simultaneously rotating said drill string to effect a cutting action through said subsoil; and (e) intermittently terminating said rotating action and increasing said predetermined fluid pressure of said viscous fluid to a second pressure to effect a change in the cutting direction of said nozzle means and said trailing pipe by moving said other end of the rod relative to the bendable member thereby bending said bendable member away from its longitudinal axis and thereafter reducing the pressure of said viscous fluid to said predetermined first pressure whereby said bendable member will relax and return to a position generally parallel to its longitudinal axis and thereafter effecting rotation of said drill pipe with said fluid flow at said first predetermined pressure to continue cutting said bore.

12. The mechanism of claim 1 wherein said means responsive to said increase in the given fluid pressure for causing said bendable member to bend comprises means for effecting longitudinal movement of said rod in response to the increased pressure change in the fluid so as to force said bendable member to bend.

* * * * *